US005376328A

United States Patent [19]

Hoshino et al.

[11] Patent Number: 5,376,328

[45] Date of Patent: Dec. 27, 1994

[54] PRECIOUS METAL ARTICLE, METHOD FOR MANUFACTURING SAME, MOLDABLE MIXTURE FOR USE IN MANUFACTURE OF SAME AND METHOD FOR PRODUCING MOLDABLE MIXTURE

[75] Inventors: Koji Hoshino, Saitama; Masaki Morikawa, Hyogo; Tohru Kohno, Saitama; Koshiro Ueda, Saitama; Masaki Miyakawa, Saitama, all of Japan

[73] Assignee: Mitsubishi Materials Corporation, Tokyo, Japan

[21] Appl. No.: 231,101

[22] Filed: Apr. 22, 1994

Related U.S. Application Data

[63] Continuation of Ser. No. 978,507, Nov. 18, 1992, Pat. No. 5,328,775, which is a continuation-in-part of Ser. No. 701,869, May 17, 1991, abandoned.

[30] Foreign Application Priority Data

| | | | |
|---|---|---|---|
| May 18, 1990 | [JP] | Japan | 2-128447 |
| Jul. 6, 1990 | [JP] | Japan | 2-178753 |
| Sep. 11, 1990 | [JP] | Japan | 2-241014 |
| Sep. 11, 1990 | [JP] | Japan | 2-241015 |
| Sep. 11, 1990 | [JP] | Japan | 2-241016 |
| Sep. 11, 1990 | [JP] | Japan | 2-241017 |
| Sep. 11, 1990 | [JP] | Japan | 2-241018 |
| Oct. 9, 1990 | [JP] | Japan | 2-270938 |
| Oct. 9, 1990 | [JP] | Japan | 2-270939 |

[51] Int. Cl.[5] ..... B22F 1/00

[52] U.S. Cl. ..... 419/36; 419/61; 75/252; 75/255

[58] Field of Search ..... 419/36, 37, 38, 61; 75/252, 255

[56] References Cited

U.S. PATENT DOCUMENTS

| | | | |
|---|---|---|---|
| 3,502,446 | 2/1968 | Vickery | 75/208 |
| 5,080,846 | 1/1992 | Kim et al. | 264/109 |
| 5,194,203 | 3/1993 | Kankawa et al. | 264/63 |
| 5,238,751 | 8/1993 | Van der Zel | 428/570 |

*Primary Examiner*—Donald P. Walsh
*Assistant Examiner*—Anthony R. Chi
*Attorney, Agent, or Firm*—Oblon, Spivak, McClelland, Maier & Neustadt

[57] ABSTRACT

There is disclosed a precious metal article which is formed of a solid-phase sintered product of a precious metal powder. For manufacturing the precious metal article, a moldable mixture which contains a precious metal powder and a binder removable by sintering is shaped into a prescribed molded object, and the molded object is then subjected to sintering. The moldable mixture is produced by preparing a precious metal powder, preparing a jellylike cellulose binder by blending a cellulose with water and leaving for a prescribed period of time, and blending the precious metal powder and the jellylike cellulose binder together. The most preferable moldable mixture contains 50 to 90% by weight of precious metal powder, 0.8 to 8% by weight of water-soluble cellulose binder, 0.08 to 3% by weight of a surface-active agent. 0.1 to 3% by weight of oil, balance water and unavoidable impurities. The precious metal powder preferably contains gold powder and powder of an alloy containing silver or copper, and the gold powder is obtained by submerged-reduction method.

20 Claims, 7 Drawing Sheets

PRECIOUS METAL ARTICLE, METHOD FOR MANUFACTURING SAME, MOLDABLE MIXTURE FOR USE IN MANUFACTURE OF SAME AND METHOD FOR PRODUCING MOLDABLE MIXTURE

CROSS-REFERENCE TO RELATED APPLICATION

This application is a continuation of copending application Ser. No. 07/978/507, filed Nov. 18, 1992, now U.S. Pat. No. 5,328,775 which is a continuation-in-part of prior application Ser. No. 07/701,869, filed May 17, 1991, now abandoned.

BACKGROUND OF THE INVENTION

1. Field of the Invention

The present invention relates to a precious metal article for ornaments, artistic handicrafts or the like, and a method for manufacturing the same, and further to a moldable mixture specifically adapted to be employed in the manufacture of the precious metal article and a method for producing the moldable mixture itself.

2. Prior Art

Japanese Patent Application laid open with Publication No. 59-143001 describes one conventional method for manufacturing ornamental articles or artistic handicrafts, which involves preparing powders of precious metal such as gold (Au), platinum (Pt) and silver (Ag); adding binders such as clay, glue, boiled rice or wheat flour to them: subsequently mixing them together with water to produce a moldable mixture: modeling an article of a prescribed shape in this moldable mixture: and drying the resulting article at about 100° C.

Japanese Patent Application laid open with Publication No. 63-403 describes another conventional manufacturing method which includes preparing powder of metal such as nickel (Ni); adding bentonite as binder: mixing them together with water to produce a moldable mixture; modeling an article of a prescribed shape in this mixture; leaving the resulting article at room temperature for a prolonged period of time to remove water; and subsequently sintering it in a reducing atmosphere at 1,250° C.

In the above methods, various binders such as clay, glue, boiled rice, wheat flour or bentonite are added. However, these kinds of binders remain in the article in a considerable amount even after the completion of drying or sintering, and mar the color tone of the articles. Particularly, in the articles of precious metal, the special color tone of precious metal cannot be successfully reproduced.

SUMMARY OF THE INVENTION

It is therefore a primary object of the present invention to provide a precious metal article which contains no binder so that the special color tone of precious metal can be positively reproduced.

Another object of the invention is to provide a method specifically adapted to manufacture the above precious metal article free of binder.

Yet another object is to provide a moldable mixture adapted to be used in the above method of manufacturing the precious metal articles.

A further object is to provide a method for producing the moldable mixture itself.

According to a first aspect of the invention, there is provided a precious metal article consisting essentially of a solid-phase sintered product of a precious metal powder free of any binder, whereby assuming color tone of the precious metal.

According to a second aspect of the invention, there is provided a method for manufacturing a precious metal article comprising preparing a moldable mixture containing a precious metal powder and a binder which is removable by sintering, shaping the moldable mixture into a prescribed molded object, and subjecting the molded object to solid-phase sintering operation to provide the precious metal article free of the binder. Various methods can be developed by using the basic idea of this method, and various kinds of precious metal articles of high quality can be successfully produced.

According to a third aspect of the invention, there is provided a moldable mixture for use in the manufacture of a precious metal article, containing a precious metal powder and a cellulose binder mixed with the powder. It is required that the binder employed to prepare the moldable mixture be removable during the manufacture of the precious metal article. It has been found that the cellulose binder is particularly suitable for these purposes. Furthermore, in order to impart other characteristics as necessary, the moldable mixture can be modified in various ways. However, It is the most preferable that it consists essentially of 50 to 90% by weight of a precious metal powder, 0.8 to 8% by weight of a water-soluble cellulose binder, 0.08 to 3% by weight of a surface-active agent, 0.1 to 3% by weight of an adhesion-preventing agent, balance water and unavoidable impurities.

Finally, according to a fourth aspect of the invention, there is provided a method :for producing a moldable mixture for use in the manufacture of a precious metal article, comprising the steps of preparing a precious metal powder, preparing a jellylike cellulose binder by blending a cellulose with water and leaving for a prescribed period of time, and blending the precious metal powder and the jellylike cellulose binder together. In this method, a surface-active agent and/or an adhesion-preventing agent may be preferably added in order to obtain a better moldable mixture.

DETAILED DESCRIPTION OF THE INVENTION

The inventors have made an extensive study to obtain a precious metal article containing no binder, and have come to know that when a jellylike cellulose, prepared by adding water to cellulose, is used as a binder, water contained therein evaporates during the drying process while the cellulose disappears during the solid-phase sintering process. Thus, the resulting metal article is free of binder, and is essentially comprised of a solid-phase sintered product of a precious metal. Furthermore, the inventors have come to understand that if a surface-active agent is added during the mixing of binder and precious metal, a uniform mixing in a short period of time can be positively ensured. Moreover, if an adhesion-preventing agent such as di-n-butyl phthalate is mixed with the aforesaid mixture, the mixture is prevented from sticking to hand during the molding work, and this adhesion-preventing agent as well as the aforesaid surface-active agent can be removed away during the sintering step, so that the color tone of the resulting metal article is not marred.

Thus, the precious metal article in accordance with the present invention consists essentially of a solid-phase sintered product of a precious metal powder free of any binder, and assumes the special color tone of the precious metal.

According to the present invention, the precious metal article is manufactured by the steps of preparing a moldable mixture containing a precious metal and a binder which is removable by sintering, and subjecting the mixture to solid-phase sintering operation.

More specifically, there is first prepared a moldable mixture containing a precious metal powder and a cellulose binder mixed with the powder. The use of the cellulose as the binder ensures that the binder be removed away during the sintering step.

Then, the moldable mixture of a precious metal is molded into a prescribed shape, and after being dried, the molded object is sintered under predetermined conditions. Thus, the binder is removed during the sintering operation, and a precious metal article free of the binder is manufactured.

Various modifications of the manufacturing method of a precious metal article will now be described.

Figure 1A:
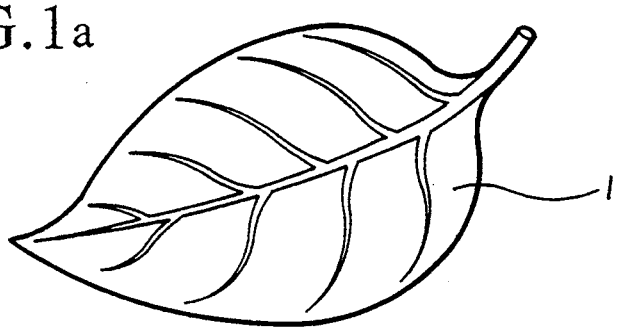
FIGS. 1*a* to 1*d* are schematic views showing the respective steps of a manufacturing method of a precious metal article in accordance with a first embodiment of the invention.
Figure 1B:
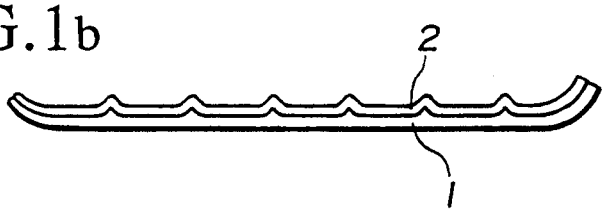
Figure 1C:
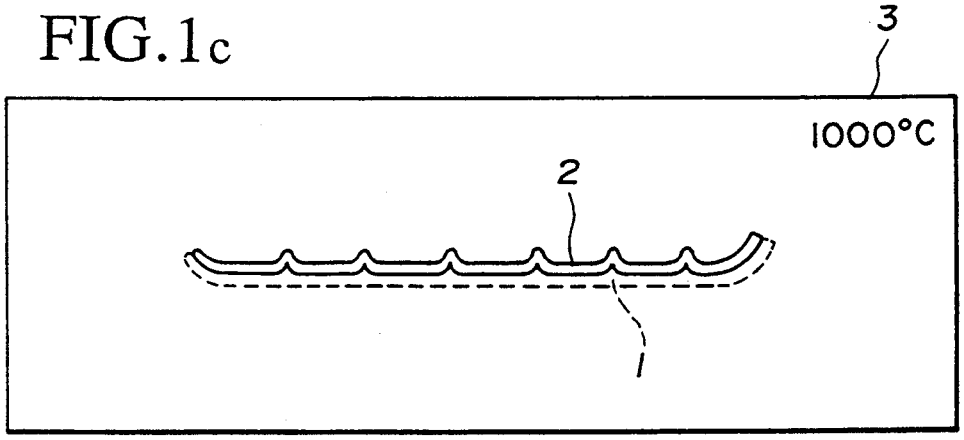
Figure 1D:
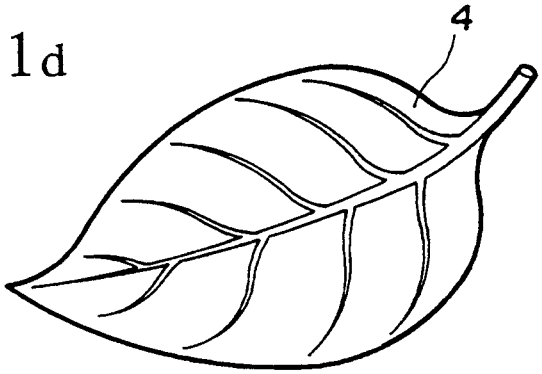

FIGS. 1*a* to 1*d* are schematic views showing the steps of the above method in accordance with a first preferred embodiment of the invention. In this method, a leaf 1 as shown in FIG. 1*a* is prepared as a combustible base object. It is preferable that a leaf of tree having a distinct vein be selected. Subsequently, as shown In FIG. 1*b*, the moldable mixture of the invention is extended thinly by hand on the surface of the leaf 1 and unnecessary portion of the mixture is removed by a bamboo spatula or the like in conformity with the shape of the leaf 1 to provide a molded object 2 having the same shape as the leaf 1. Then, as shown in FIG. 1*c*, the molded object 2 is introduced into an electric furnace 3, and subjected to solid-phase sintering operation. The sintering conditions in the electric furnace 3 differ depending upon the kinds of the moldable mixture. When the mixture is of pure gold, it may be heated in air at 1000°. However, when the mixture is of an alloy of 75.0% by weight of gold, 12.5% by weight of silver and 12.5% by weight of copper, i.e., 18-carat gold, it may be heated in an argon gas atmosphere at 800° C. During this sintering operation, the leaf 1 burns to ash, so that it can be easily removed away. With these procedures, a precious metal article 4 having a minute venous pattern reproduced from the surface of the leaf 1 can be obtained as shown in FIG. 1*d*.

In the above method, if it is desired to reproduce the vein patterns on both of the faces of the precious metal article 4, the moldable mixture is first extended thinly on the leaf 1 as shown in FIG. 1*b*, and then another leaf is placed thereon in such a manner that the mixture is sandwiched between the two leaves. Then, the sintering step is carried out under the same conditions as described above. In the foregoing, leaves of trees are selected as base objects, but other combustible materials such as paper pattern having a desired design thereon may be employed as well.

Figure 2A:
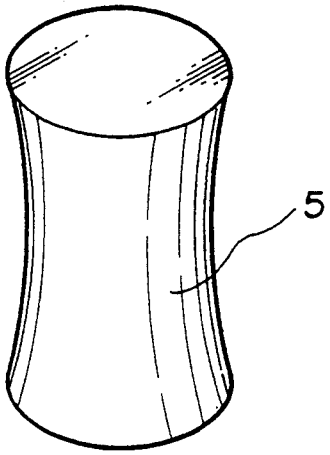
FIGS. 2*a* to 2*d* are views similar to FIGS. 1*a* to 1*d*, but showing a manufacturing method of a precious metal article in accordance with a second embodiment of the invention.
Figure 2B:
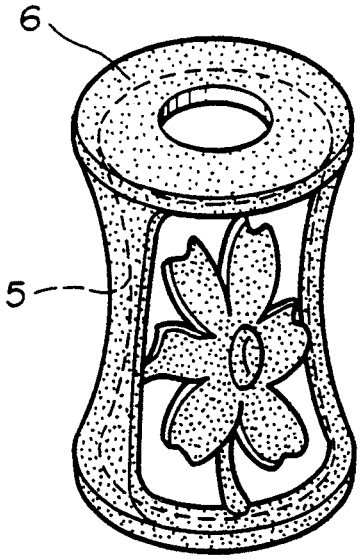
Figure 2C:
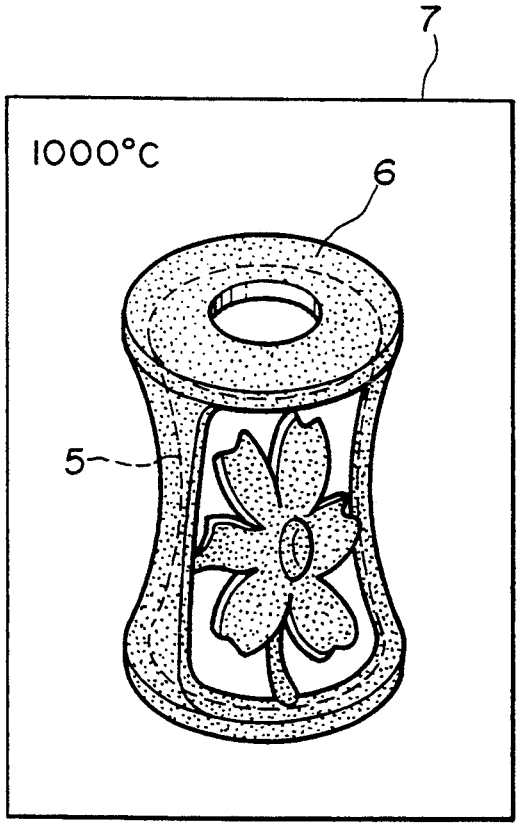
Figure 2D:
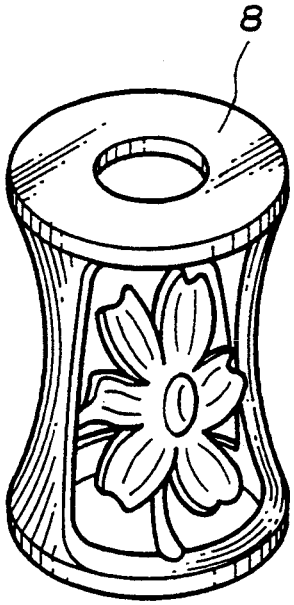

FIGS. 2*a* to 2*d* are schematic views showing the steps of the manufacturing method in accordance with a second preferred embodiment of the invention. In this embodiment, an object of wax 5 as shown in FIG. 2*a* is prepared as a base object which is removable by sintering. Then, as shown in FIG. 2*b*, a moldable mixture of the invention is extended thinly by hand on the outer surface of the object 5 and unnecessary portion of the mixture is removed by a bamboo spatula or the like to provide a molded object 6 of a prescribed shape as shown in FIG. 2*b*. Then, as shown in FIG. 2*c*, the molded object 6 is introduced into an electric furnace 7, and is subjected to solid-phase sintering by heating it at 1000° C. in air. The sintering conditions in the electric furnace 3 are the same as those previously mentioned. With the sintering step, the wax quickly evaporates, and hence only the molded object 6 is left as a precious metal article 8. In the foregoing, the wax may be replaced by any other material which is vaporizable or liquefiable during the sintering.

Figure 3A:
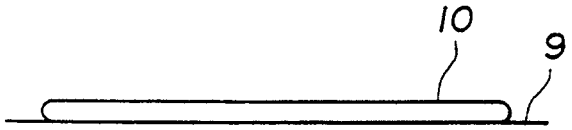
FIGS. 3*a* and 3*b* are views similar to the above, but showing a manufacturing method in accordance with a third embodiment of the invention.
Figure 3B:
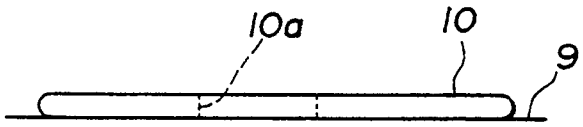

FIGS. 3*a* and 3*b* are schematic views showing the steps of the manufacturing method in accordance with a third embodiment of the invention. This embodiment is in particular suitable for manufacturing relatively small-size ornamentations such as pendants. First, a moldable mixture of the invention is placed on a working table 9 and extended thereon by a roller or the like to produce a plate 10 of the moldable mixture. Then, as shown in FIG. 3*b*, a prescribed portion 10*a* is carved and punched into a desired shape using a bamboo spatula or the like to provide a molded object. When required to manufacture many precious metal articles, it is preferable to use prescribed dies. The molded object thus obtained is introduced into an electric furnace and subjected to solid-phase sintering operation under the same conditions as described above.

Figure 4A:
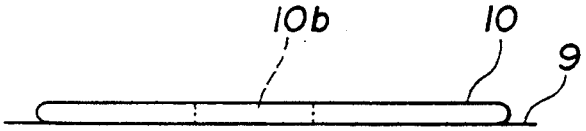
FIGS. 4*a* and 4*b* are views showing a modification of the method shown in FIGS. 3*a* and 3*b;*
Figure 4B:
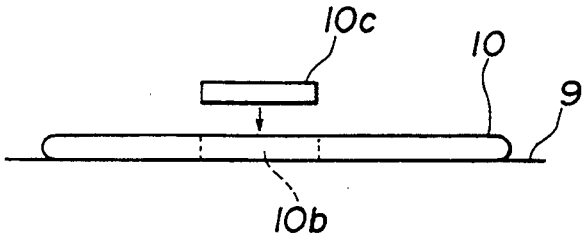

This method may be further modified so as to be suitably adapted for manufacturing artistic handicrafts of a relatively large size such as picture platters. More specifically, as shown in FIG. 4*a*, the above procedures are repeated to produce a plate 10 of mixture, and a prescribed portion 10*b* is removed away using a bamboo spatula. Then, as shown in FIG. 4*b*, another moldable mixture 10*c*, which assumes a color tone different from that of the plate 10, is stuffed into the vacant portion 10*b* of the plate 10 to provide a molded object. Then, the sintering operation is effected in a similar way. In this case, two or more portions may be removed from the plate, and moldable mixtures of different colors may be stuffed thereinto, respectively.

Figure 5A:
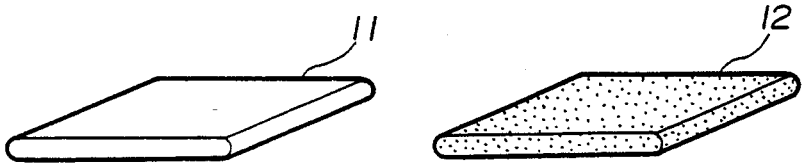
FIGS. 5*a* to 5*e* are views similar to the above, but showing a manufacturing method in accordance with a fourth embodiment of the invention.
Figure 5B:
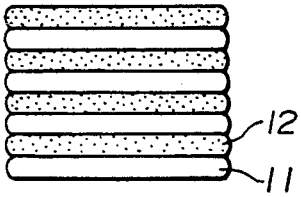
Figure 5C:
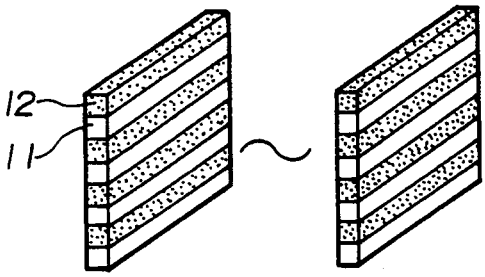
Figure 5D:
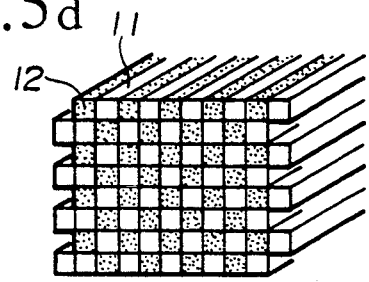
Figure 5E:
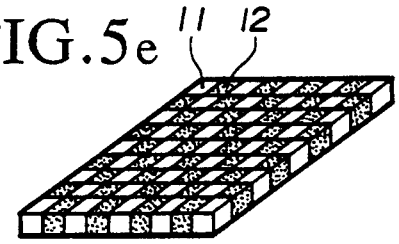
Figure 6A:
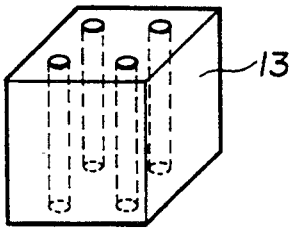
FIGS. 6*a* to 6*c* are views showing a modification of the method shown in FIGS. 5*a* to 5*e;*
Figure 6B:
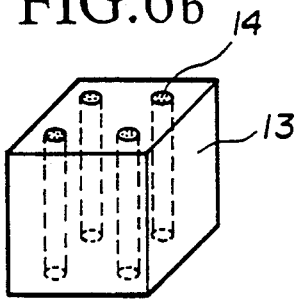
Figure 6C:
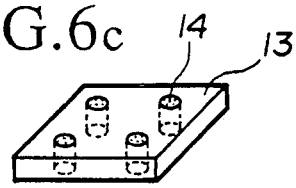

FIGS. 5*a* to 5*e* are schematic views showing the steps of the manufacturing method in accordance with a fourth embodiment of the invention. First, as shown in FIG. 5*a*, a plurality of plates of moldable mixtures 11 and 12, which assume different colors after the sintering operation, are prepared and formed flat by a roller. Then, as shown in FIG. 5*b*, the mixtures 11 and 12 are placed one upon another with alternations of different colors. Thereafter, as shown in FIG. 5*c*, the plates of mixtures are vertically cut in pieces each having a stripe pattern, and as shown in FIG. 5*d*, these stripe pieces are piled one upon another in such a manner that the mixtures of different colors are displaced adjacent to each other. Then, after having trimmed the ends, the piled mixtures are sliced in a prescribed direction to produce sliced plates each having a checker pattern as shown in FIG. 5*e*. Sliced plates thus obtained are sintered in an electric furnace or the like under the same conditions as described above, so that precious metal articles having checker patterns can be obtained.

The method shown in 6*a* to 6*c* is another modification, wherein a moldable mixture 13 is shaped into a rectangular parallelepiped, and a plurality of apertures of a prescribed cross-sectional shape are formed therethrough. Then, another moldable mixture 14 of different color is stuffed into each of the apertures. In this case, moldable mixtures 14 of different colors may be stuffed. The rectangular parallelepiped thus formed is cut into slices each having a pattern in which plural isolated portions of different color are scattered. These sliced plates are then sintered under the same conditions as described above.

Figure 7A:
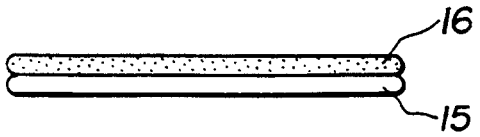
FIGS. 7*a* to 7*c* are views showing another modification of the method shown in FIGS. 5*a* to 5*e;*
Figure 7B:
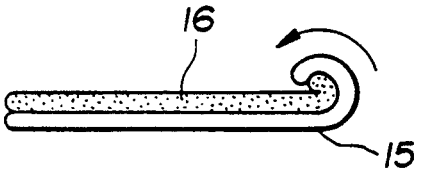
Figure 7C:
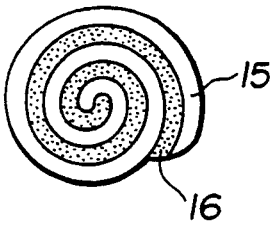

This method may be further modified as shown in FIGS. 7*a* to 7*c*. in this modification, two plates 15 and 16 of different moldable mixtures are placed one upon another, and are wound round as depicted in FIG. 7*b*. The cylindrical mixtures thus formed are then sliced into circular disks each having a vortex pattern. These disks are finally sintered in a furnace to provide precious metal articles having vortex patterns.

In the foregoing, two or more moldable mixtures may be blended together before the molding operation. With this modification, precious metal articles having complicated patterns can be obtained. Moreover, the article obtained by the sintering operation may be further subjected to plastic working to thereby modify the shape of the article.

Figure 8A:
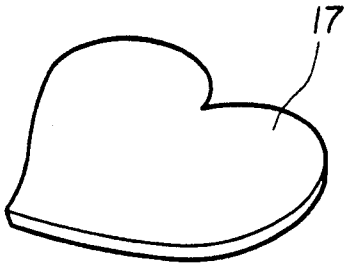
FIGS. 8*a* to 8*d* are views similar to the above, but showing a manufacturing method in accordance with a fifth embodiment of the invention.
Figure 8B:
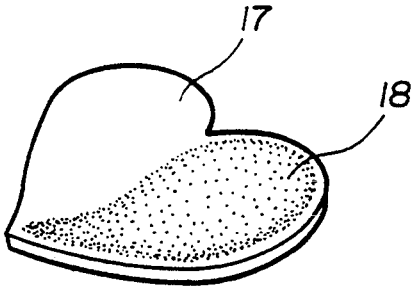
Figure 8C:
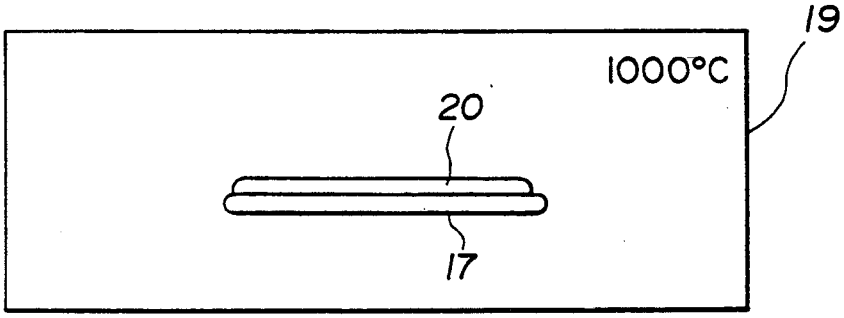
Figure 8D:
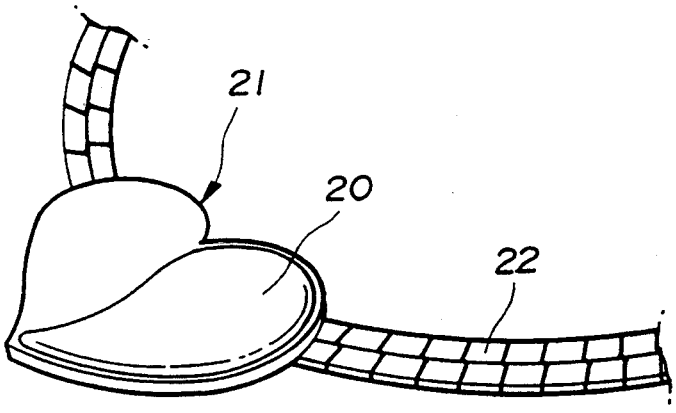

FIGS. 8*a* to 8*d* are schematic views showing the steps of the manufacturing method in accordance with a fifth embodiment of the invention. This embodiment is also suitable for manufacturing relatively small-size ornamentations such as pendants. First, a prescribed moldable mixture is placed on a working table and extended thereon by a roller or the like, and shaped by handwork with a bamboo spatula or the like or punching operation into a heart-shaped molded object 17 as shown in FIG. 8*b*. Then, as shown in FIG. 8*b*, powdered glass 18 is caused to adhere to its surface at a prescribed portion thereof, and is sintered in a furnace 19 under the same conditions as described above. Thus, as is the case with cloisonne, a glassy layer 20 is formed on a desired portion on the surface, and a precious metal article 21 having a glassy portion 20 on its surface can be obtained. This article 21 is, for example, secured to a necklace 22.

In the foregoing, if a coloring agent is mixed into the powdered glass, a glassy layer of a desired color can be obtained. The shape of the article is of course arbitrary. Furthermore, a suitable Jewel may be directly attached to the moldable mixture before the sintering operation. With this procedure, the jewel attached to the mixture remain in the resulting article as it is, so that a precious metal article having a jewel secured thereto in advance can be obtained.

Next, the moldable mixture for use in the manufacture of the above precious metal article and the method for producing the same will be described.

As previously mentioned, the moldable mixture in accordance with the invention is characterized in that it contains a precious metal powder and a cellulose binder mixed with the powder. The use of the cellulose as the binder ensures that the binder is removed away during the sintering step. For producing the moldable mixture, a water-soluble cellulose is prepared and blended with water, and is left for a predetermined period of time to thereby produce a jellylike cellulose binder. It is preferable that cellulose and water are blended at a ratio of cellulose to water ranging from 5/95 to 30/70. Then, the resulting binder and a prescribed precious metal powder are blended preferably in an amount of 7 to 33% by weight with respect to the total amount of the mixture.

In the foregoing, it is more preferable that 0.05 to 5% by weight of a surface-active agent such as alkyl benzene sodium sulfonate or polysoap and/or 0.5 to 10% by weight of an adhesion-preventing agent such as oil may be added to the jellylike substance and mixed together. Thus, the most preferable binder is such that it contains the surface-active agent and the adhesion-preventing agent, and consists essentially of 50 to 90% by weight of the precious metal powder, 0.8 to 8% by weight of the water-soluble cellulose binder, 0.03 to 3% by weight of the surface-active agent and 0.1 to 3% by weight of the adhesion-preventing agent, balance water and unavoidable impurities. This moldable mixture is prepared by blending cellulose binders with water to leave them for a while until jelly substance is formed, adding the active-surface agent to the jelly substances and mixing them together, mixing the precious metal powder therewith, and further adding the adhesion-preventing agent to produce the moldable mixture.

The reasons for the limitations on the composition of the most preferred moldable mixture are as follows:

(a) Precious metal powder:

Powders of precious metal such as gold, silver, copper, platinum and their alloys are main constituents for the moldable material to be obtained. If the content is less than 50% by weight, desired effects cannot be obtained. On the other hand, if the content exceeds 90% by weight, the resulting moldable material is inferior in extensibility and strength. Therefore, the content of the precious metal powder has been determined so as to range from 50 to 90% by weight.

In addition, if the average particle size of the precious metal powder exceeds 200 μm, the extensibility and strength are deteriorated. Therefore, it is preferable that the average particle size of the precious metal powder is no greater than 200 μm.

(b) Water-soluble cellulose binder:

When heated, the water soluble binder is quickly gelled, so that it is very easy to keep the shape of the molded article. However, if the binder content is less than 0.8% by weight, such an advantage cannot be obtained. On the other hand, if the content exceeds 8% by weight, fluidity is unduly increased, so that it becomes difficult to mold the mixture. Therefore, the content of the cellulose binder is determined so as to range from 0.8 to 8% by weight.

In the foregoing, methyl cellulose and/or ethyl cellulose are favorably used as the water-soluble binder of the above kind.

(c) Surface-active agent:

A surface-active agent breaks solid substances which are formed by the reaction of the binder with water, and facilitates an efficient mixing of the precious metal powder with the binder. However, if its content is less than 0.03% by weight, desired effects cannot be obtained. On the other hand, if the content exceeds 3% by weight, the fluidity of the moldable mixture is unduly reduced, so that molding operation cannot be smoothly carried out. Accordingly, the content of the surface-active agent to be added is determined so as to range from 0.03 to 3% by weight. As described above, polysoap or alkyl benzene sodium sulfonate is preferable as this agent.

(d) Adhesion-preventing agent:

When a small amount of adhesion-preventing agent, or oil and fat, is added, the moldable mixture is prevented from sticking to hand during the molding operation. However, if the content is less than 0.1% by weight, the effects cannot be obtained. On the other hand, if the content exceeds 3% by weight, the moldable mixture becomes oily and slippery, resulting in poor handling characteristics. Therefore, the content of the adhesion-preventing agent is determined so as to range from 0.1 to 3% by weight.

This agent may include higher organic acid such as phthalic acid, higher organic ester such as di-n-octyl phthalate or di-n-butyl phthalate, higher alcohol, higher polyhydric alcohol such as polyvinyl alcohol, .polyethylene glycol, and higher ether.

Furthermore, it has been found that when ethylene glycol is added in an amount of no greater than 30% by weight, preferably 2 to 10% by weight, with respect to water, the moldability of the resulting mixture can be further improved. However, if the content exceeds 30% by weight, the viscosity is reduced, so that the moldability deteriorates instead.

Moreover, the precious metal powder to be used in the manufacture of the moldable mixture of the invention will be hereinafter explained.

The precious metal powder to be used in the invention may contain various kinds of precious metal powders. As described above, the moldable mixtures of different colors may be used in the invention. In this case, the color can be controlled by the blending composition of the powder. More specifically, in order to emphasize whitish color, a precious metal powder containing an increased amount of palladium (Pd), nickel, silver or the like is preferably used, while the reddish color tone can be achieved by increasing the copper content.

Furthermore, in the precious metal powder to be used in the invention, gold powder is mainly utilized, but powder of an alloy of various precious metals is also contained in order to control the moldability of the mixture and the strength and color tone of the resulting precious metal article. Since it is impossible to produce the alloy powder by submerged-reduction method, the alloy powder as well as the gold powder are conventionally manufactured by a gas atomizing process or a water atomizing process. However, when manufactured by the atomizing process, the average particle sizes of the obtained powders are varied widely, so that a moldable mixture having excellent and stable quality cannot be obtained.

In order to overcome the above problems, gold powder is manufactured by means of submerged reduction method, and the alloy powder is manufactured by atomizing method. More specifically, 5 l of aqueous $AuCl_3$ solution having a concentration of 46 g/l and 5 l of aqueous $K_2SO_3$ solution having a concentration of 70 g/l are quickly blended at a temperature of −10° C. to +5° C., preferably at 2° C. With this procedure, the following reaction takes place, and particles of gold powder precipitates in 5 to 10 seconds.

$$2AuCl_3+3K_2SO_3+3H_2O\rightarrow 2Au+3K_2SO_4+6HCl$$

Then, these precipitates are filtered to produce gold powder. The gold thus obtained has a particle size of about 10 to 100 μm, and each individual particle of the powder has protuberances of about 0.1 to 1 μm adherent thereto. With these constructions, when the gold powder is blended together with the binder and/or the other precious metal powder, their particles get caught in the binder and/or the other alloy powder, so that the moldable mixture produced using this powder exhibits an excellent quality.

In the foregoing, if the temperature of the aqueous solution is less than −10° C., the rate of reaction is reduced. On the other hand, if the temperature exceeds 5° C., the obtained particles become small in size, so that the particles flocculate.

Furthermore, as described above, the alloy powders which are to be blended with the above gold powder are manufactured by means of atomizing method, Namely, alloy powder containing silver or copper, alloy powder containing nickel or palladium, or alloy powder containing zinc (Zn), cobalt (Co), beryllium (Be), tin (Sn) or indium (In) is manufactured. With respect to the powder containing silver or copper, the hardness, strength, color tone and the like of the moldable mixture can be changed by controlling the content. Also , nickel or palladium is suitable to emphasize white. Zinc is effective to regulate the color tone. Cobalt , beryllium, tin or indium enhances the strength of the moldable mixture. These powders may be manufactured in the state of alloy, but may be produced by blending the individual precious metal powders which have been independently produced.

Figure 9:
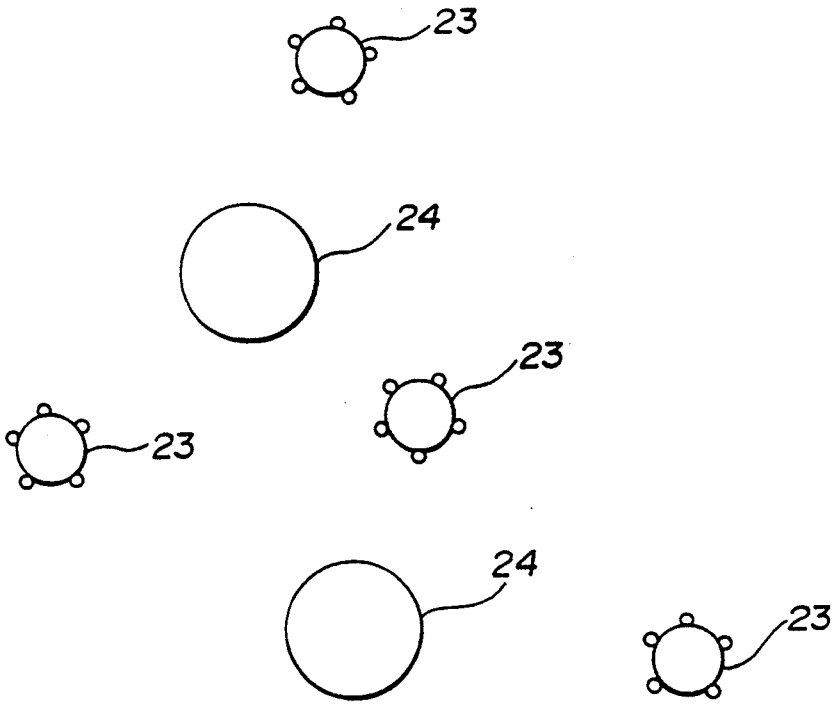
FIG. 9 is a schematic enlarged view showing particles of a precious metal powder in accordance with a preferred embodiment of the invention.

The gold powder and the alloy powder thus obtained are blended together such that gold versus alloy is 75% : 25%. FIG. 9 is a view schematically showing the particles of gold and alloy thus obtained, in which the gold powder and the alloy powder are designated by the numerals 23 and 24, respectively.

The present invention will now be described in more detail by way of the following examples:

EXAMPLE 1

Methyl cellulose, selected as water-soluble cellulose binder, was mixed with water and left over night to produce gelatinous substances. A surface-active agent was added to the gelatinous substances and mixed in a mortar, and then powder of gold having an average particle size of 20 μm was added thereto. After mixed in the mortar again, di-n-buthyl phthalate was added to the mixture and mixed in the mortar. Thus, moldable mixtures 1 to 22 of the invention and comparative moldable mixtures 1 to 8 each having the composition as set forth in Tables 1-1 and 1-2 were manufactured.

Furthermore, prior art moldable mixture 1 containing gold powder which is used in a conventional doctor blade method, was prepared, and prior art moldable mixture 2 was also produced by adding bentonite power and water to the above gold powder.

20 g of each of the moldable mixtures 1 to 22 of the invention, the comparative moldable mixtures 1 to 8 and the prior art moldable mixtures 1 and 2 was molded into a sphere, and placed between the upper and lower molds. Then, the material was pressed until the thickness reached 1.0 mm, and the resulting pressed compacts were taken out from the molds. Furthermore, the weight of the moldable mixture adhering to the surfaces of the upper and lower molds were measured. The results are shown in Tables 1-1 and 1-2.

Subsequently, the pressed compacts were introduced into an electric furnace without drying them, and were heated at a heating speed of 20° C./min and sintered by holding them in air atmosphere at 1050° C. for one hour. Then the existence of cracks on the surface of the sintered products were observed, and the results are also set forth in Tables 1-1 and 1-2.

As will be seen from Tables 1-1 and 1-2, the prior art moldable mixture 1 cannot be molded due to unduly high fluidity, while the prior art moldable mixture 2 much adhered to the upper and lower molds and cracks were developed in the sintered product. In contrast, with respect to the moldable mixtures 1 to 22 of the invention, the amount adhering to the upper and lower molds are extremely small, and no cracking was observed even when the pressed compacts were sintered in an electric furnace without drying.

Furthermore, it is seen from the results that defects shown in Tables 1-1 and 1-2 occur in the comparative moldable mixtures 1 to 8, in which the values falling outside the ranges of the invention are marked by The symbols * .

EXAMPLE 2

Various jelly binders were prepared by blending cellulose so as to have compositions set forth in Table 2, and polysoap was blended as accelerator for mixing. Then, precious metal powders having an average particle size of no greater than 15 μm were blended to produce moldable mixtures, and further di-n-butyl phthalate was mixed as an adhesion-preventing agent in an amount as set forth in Table 2. Using the moldable mixtures thus prepared, annular molded articles having an outer diameter of 17 mm, an inner diameter of 15 mm and a thickness of 1 mm were molded. Thereafter, the molded articles were subjected drying and sintering under the conditions as set forth in Table 2 to provide precious metal articles 1 to 16 of the invention.

Then, the resulting articles were tested as to the theoretical density ratio and precious metal content. The results are set forth in Table 2.

As will be seen from Table 2, it is clear that the precious metal articles 1 to 16 of the invention contain substantially no binders, surface-active agents and/or adhesion-preventing agents.

EXAMPLE 3

The same procedures as in Example 2 were repeated using various precious metal powders and other additives as set forth in Tables 3-1 and 3-2 to provide precious metal articles 17 to 41 of the invention. Further, the resulting articles were tested as to the theoretical density ratio and precious metal content. The results are also set forth in Tables 3-1 and 3-2.

As will be seen from the results, it is clear that the precious metal articles 17 to 41 of the invention contain substantially no binders, surface-active agents and so on.

Obviously many modifications and variations of the present invention are possible in the light of the above. It is therefore to be understood that within the scope of the appended claims, the invention may be practiced otherwise than as specifically described.

TABLE 1-1

| Moldable mixtures of the invention | Composition of moldable mixture (wt %) | | | | | | Residual mixture adherent to dies (mg) | Presence of cracks | Remarks |
|---|---|---|---|---|---|---|---|---|---|
| | Au powder | Ethyl cellulose | Surface active agent | Di-n-butyl phthalate | Ethylene glycol | Water & impurities | | | |
| 1 | 50 | 5.0 | 0.5 | 0.5 | — | bal. | 1 | none | not deformed |
| 2 | 60 | 4.0 | 0.4 | 0.4 | — | bal. | 1 | none | not deformed |
| 3 | 70 | 2.5 | 0.2 | 0.5 | — | bal. | 1 | none | not deformed |
| 4 | 80 | 2.5 | 0.2 | 1.0 | — | bal. | 1 | none | not deformed |
| 5 | 90 | 2.0 | 0.2 | 1.0 | — | bal. | 1 | none | not deformed |
| 6 | 80 | 0.8 | 0.04 | 1.0 | — | bal. | 1 | none | not deformed |
| 7 | 80 | 2.0 | 0.4 | 0.7 | — | bal. | 1 | none | not deformed |
| 8 | 80 | 4.0 | 1.0 | 2.0 | — | bal. | 1 | none | not deformed |
| 9 | 70 | 6.0 | 2.0 | 2.5 | — | bal. | 1 | none | not deformed |
| 10 | 50 | 8.0 | 2.0 | 2.5 | — | bal. | 1 | none | not deformed |
| 11 | 70 | 2.5 | 0.03 | 1.0 | — | bal. | 1 | none | not deformed |
| 12 | 70 | 2.5 | 0.1 | 1.0 | — | bal. | 1 | none | not deformed |
| 13 | 70 | 2.5 | 1.0 | 1.0 | — | bal. | 1 | none | not deformed |
| 14 | 80 | 3.0 | 2.0 | 1.0 | — | bal. | 1 | none | not deformed |
| 15 | 50 | 8.0 | 3.0 | 1.0 | — | bal. | 1 | none | not deformed |
| 16 | 80 | 2.5 | 0.2 | 0.1 | — | bal. | 1 | none | not deformed |
| 17 | 80 | 2.5 | 0.2 | 1.0 | — | bal. | 1 | none | not deformed |
| 18 | 80 | 2.5 | 0.2 | 2.0 | — | bal. | 1 | none | not deformed |
| 19 | 70 | 2.5 | 0.2 | 3.0 | — | bal. | 1 | none | not deformed |
| 20 | 60 | 4.0 | 0.4 | 0.4 | 0.5 | bal. | 1 | none | not deformed |
| 21 | 70 | 2.5 | 0.2 | 0.5 | 2.0 | bal. | 1 | none | not deformed |
| 22 | 50 | 5.0 | 0.5 | 0.7 | 11.0 | bal. | 1 | none | not deformed |

TABLE 1-2

| | Composition of moldable mixture (wt %) | | | | | Residual mixture adherent to dies (mg) | Presence of cracks | Remarks |
|---|---|---|---|---|---|---|---|---|
| | Au powder | Ethyl cellulose | Surface active agent | Di-n-butyl phthalate | Water & impurities | | | |
| Comparative moldable mixtures | | | | | | | | |
| 1 | 40* | 5.0 | 0.5 | 0.5 | balance | 1 | none | sintered product was deformed |
| 2 | 97* | 2.0 | 0.2 | 0.5 | balance | 2 | presence | slightly inferior in plasticity |
| 3 | 70 | 0.3* | 0.1 | 1.0 | balance | 2 | presence | sintered product was deformed |
| 4 | 70 | 9.0* | 0.5 | 1.0 | balance | 3 | none | inferior in plasticity |
| 5 | 70 | 2.5 | 0.01* | 1.0 | balance | 1 | presence | a number of pores observed |
| 6 | 70 | 2.5 | 4.0* | 1.0 | balance | 10 | none | unable to mold by hand due to great fluidity |
| 7 | 80 | 2.5 | 0.2 | 0.05* | balance | 124 | none | — |
| 8 | 80 | 3.0 | 0.3 | 4.0* | balance | 1 | none | oily and slippery, poor handling characteristics |
| Prior air mixtures | | | | | | | | |
| 1 | 75 | 0.5 | 0.01 | Polyvinyl alcohol 0.2 | balance | unable to test due to fluidity | none | unable to mold by hand due to great fluidity |
| 2 | 92 | | Bentonite:5 | | balance | 114 | presence | — |

*denotes the values falling outside the ranges of the invention.

TABLE 2

| Precious metal articles of the invention | Blending composition (wt %) | | | | | | | | |
|---|---|---|---|---|---|---|---|---|---|
| | Precious metal powder | | | Methyl cellulose | Ethyl cellulose | Water | Binder (weight ratio) | Polysoap | Di-n-butyl phthalate |
| | Au powder | Pt powder | Ag powder | | | | | | |
| 1 | 80 | — | — | — | 5 | 95 | 20 | — | — |
| 2 | 88 | — | — | 15 | — | 85 | 12 | 0.1 | — |
| 3 | 90 | — | — | — | 15 | 85 | 10 | — | 5 |
| 4 | 92 | — | — | — | 30 | 70 | 8 | 0.05 | 2 |
| 5 | — | 80 | — | 5 | — | 95 | 20 | — | — |
| 6 | — | 90 | — | 15 | — | 85 | 10 | 5 | — |
| 7 | — | 88 | — | — | 15 | 85 | 12 | — | 1 |
| 8 | — | 93 | — | — | 30 | 70 | 7 | 0.5 | 0.5 |
| 9 | — | — | 67 | — | 5 | 95 | 33 | — | — |
| 10 | — | — | 78 | — | 15 | 85 | 22 | — | 4 |
| 11 | — | — | 82 | 15 | — | 85 | 18 | 0.2 | — |
| 12 | — | — | 84 | — | 30 | 70 | 16 | 1 | 10 |
| 13 | 80 | — | — | — | 5 | 90<br>5** | 20 | — | — |
| 14 | 85 | — | — | 15 | — | 75<br>10** | 15 | 0.1 | — |
| 15 | — | 90 | — | — | 15 | 60<br>25** | 10 | — | 0.7 |
| 16 | — | — | 80 | — | 20 | 79<br>1** | 20 | 0.1 | 2 |

| Precious metal articles of the invention | Drying conditions | | | Solid-phase sintering conditions | | | Precious metal article | |
|---|---|---|---|---|---|---|---|---|
| | Atmosphere | Temp. (°C.) | Time (Hour) | Atmosphere | Temp. (°C.) | Time (Hour) | Theoretical density ratio (%) | Precious metal content (wt %) |
| 1 | Atmos-pheric air | 105 | 1 | Atmos-pheric air | 1050 | 10 | 95 | 100 |
| 2 | | | | | | | 98 | 100 |
| 3 | | | | | | | 96 | 100 |
| 4 | | | | | | | 98 | 100 |
| 5 | | | | | 1450 | | 92 | 100 |
| 6 | | | | | | | 94 | 100 |
| 7 | | | | | | | 93 | 100 |
| 8 | | | | | | | 95 | 100 |
| 9 | | | | | 920 | | 96 | 100 |
| 10 | | | | | | | 96 | 100 |
| 11 | | | | | | | 98 | 100 |
| 12 | | | | | | | 98 | 100 |
| 13 | | | | | 1050 | | 96 | 100 |
| 14 | | | | | 1050 | | 97 | 100 |

TABLE 2-continued

| | | | |
|---|---|---|---|
| 15 | 1450 | 94 | 100 |
| 16 | 920 | 98 | 100 |

**denotes ethylene glycol.
Polysoap and di-n-butyl phthalate contents are the percentages with respect to the total amount of precious metal powder and binder.

TABLE 3-1

| Precious metal articles of the invention | Blending composition (wt %) | | | | | | | | | |
|---|---|---|---|---|---|---|---|---|---|---|
| | Precious metal powder | | Methyl cellulose | Ethyl cellulose | | Water | Surface active agent | | Adhesion preventing agent | |
| | | (wt %) | (wt %) | (wt %) | Binder (wt %) | (wt %) | | (wt %) | | (wt %) |
| 17 | Pt | 89 | — | 0.8 | 0.8 | 9.1 | polysoap | 0.4 | ester | 0.7 |
| 18 | Pt | 50 | — | 0.9 | 0.9 | 44.1 | sulfonate | 2.5 | ester | 2.5 |
| 19 | Pt | 85 | 0.9 | — | 0.9 | 13.1 | polysoap | 0.5 | ether | 0.5 |
| 20 | Pt | 79 | 2.3 | 2.7 | 5.0 | 15.0 | polysoap | 0.4 | alcohol | 0.6 |
| 21 | Pt | 80 | 5.3 | — | 5.3 | 13.0 | polysoap | 0.8 | organic acid | 0.9 |
| 22 | Ag | 80 | — | 1.8 | 1.8 | 17.0 | sulfonate | 0.4 | ester | 0.8 |
| 23 | Ag | 81 | 1.8 | — | 1.8 | 16.0 | polysoap | 0.3 | alcohol | 0.9 |
| 24 | Ag | 79 | 1.3 | 1.5 | 2.8 | 17.0 | polysoap | 0.4 | ether | 0.8 |
| 25 | Ag | 50 | 0.9 | — | 0.9 | 44.3 | sulfonate | 2.5 | organic acid | 2.3 |
| 26 | Ag | 53 | 3.8 | 3.4 | 7.2 | 35.0 | polysoap | 2.0 | polyhydric alcohol | 2.8 |
| 27 | Au | 89 | 0.9 | — | 0.9 | 9.0 | polysoap | 0.5 | ester | 0.6 |
| 28 | Au | 90 | 0.8 | — | 0.8 | 8.2 | sulfonate | 0.4 | alcohol | 0.6 |
| 29 | Au | 89 | — | 3.5 | 3.5 | 6.8 | sulfonate | 0.3 | ether | 0.4 |
| 30 | Au | 90 | 0.8 | 0.8 | 1.6 | 7.5 | polysoap | 0.5 | ester | 0.4 |
| 31 | Au | 51 | 0.9 | — | 0.9 | 43.3 | polysoap | 2.5 | polyhydric alcohol | 2.3 |
| 32 | Cu | 69 | 2.9 | 1.5 | 4.4 | 25.9 | polysoap | 0.4 | ester | 0.3 |

| Percious metal articles of the invention | Drying conditions | | | Solid phase sintering conditions | | | Precious metal article | |
|---|---|---|---|---|---|---|---|---|
| | Atmosphere | Temp. (°C.) | Time (Hour) | Atmosphere | Temp. (°C.) | Time (Hour) | Theoretical density ratio (wt %) | Predious metal content (wt %) |
| 17 | Atmos- | 105 | 1 | Air | 1580 | 10 | 78.0 | 100 |
| 18 | pheric | | | | | | 48.3 | 100 |
| 19 | air | | | | 1500 | | 79.8 | 100 |
| 20 | | | | Argon | 1400 | | 75.0 | 100 |
| 21 | | | | | 1450 | | 80.0 | 100 |
| 22 | | | | Air | 770 | | 75.0 | 100 |
| 23 | | | | | 850 | | 79.1 | 100 |
| 24 | | | | | | | 80.6 | 100 |
| 25 | | | | Argon | 900 | | 45.3 | 100 |
| 26 | | | | | | | 47.2 | 100 |
| 27 | | | | Air | 1050 | | 73.2 | 100 |
| 28 | | | | | 1000 | | 68.9 | 100 |
| 29 | | | | | 980 | | 72.5 | 100 |
| 30 | | | | | 950 | | 70.3 | 100 |
| 31 | | | | Argon | 1050 | | 50.1 | 100 |
| 32 | | | | | 900 | | 73.5 | 100 |

sulfonate = alkyl benzene sodium sulfonate; organic acid = phthalic acid; ester = di-n-butyl phthalate
alcohol = hexanol; polyhydric alcohol = polyvinyl alcohol; ester = phenetole

TABLE 3-2

| Precious metal articles of the invention | Blending composition (wt %) | | | | | | | | | |
|---|---|---|---|---|---|---|---|---|---|---|
| | Precious metal powder | | Methyl cellulose | Ethyl cellulose | | Water | Surface active agent | | Adhesion preventing agent | |
| | [composition] | (wt %) | (wt %) | (wt %) | Binder (wt %) | (wt %) | | (wt %) | | (wt %) |
| 33 | Au alloy [Au-5Ag] | 87 | 0.9 | | 0.9 | 11.0 | polysoap | 0.6 | ester | 0.5 |
| 34 | Au alloy [Au-10Ag] | 90 | 0.4 | 0.4 | 0.8 | 8.2 | sulfonate | 0.5 | polyhydric alcohol | 0.5 |
| 35 | Au alloy [Au-20Pd-5Ag] | 88 | — | 0.8 | 0.8 | 10.1 | polysoap | 0.5 | ester | 0.6 |
| 36 | Pt alloy [Pt-10Pd] | 50 | — | 0.8 | 0.8 | 44.2 | polysoap | 2.7 | ether | 2.3 |
| 37 | Ag alloy [Ag-7.5Cu] | 81 | 0.9 | 0.9 | 1.8 | 16.0 | polysoap | 0.4 | ester | 0.8 |
| 38 | Au alloy [Au-15Pd-7Ni-3Zn] | 89 | 1.0 | — | 1.0 | 8.9 | polysoap | 0.4 | ester | 0.7 |
| 39 | Au alloy [Au-10Pd-12Ni-3Zn] | 88 | 1.2 | — | 1.2 | 9.7 | sulfonate | 0.5 | ether | 0.6 |
| 40 | Au alloy [Au-20Pd-5Sn] | 90 | 0.5 | 0.4 | 0.9 | 8.0 | polysoap | 0.6 | alcohol | 0.5 |
| 41 | Au alloy | 88 | — | 1.2 | 1.2 | 9.7 | polysoap | 0.5 | ester | 0.6 |

TABLE 3-2-continued

[Au-32.5Ag-30Cu]

| Precious metal articles of the invention | Drying conditions | | | Solid-phase sintering conditions | | | Precious metal article | |
|---|---|---|---|---|---|---|---|---|
| | Atmosphere | Temp. (°C.) | Time (Hour) | Atmosphere | Temp. (°C.) | Time (Hour) | Theoretical density ratio (wt %) | Precious metal content (wt %) |
| 33 | Atmos- | 105 | 1 | Air | | 10 | 72.5 | 100 |
| 34 | pheric | | | | 1000 | | 70.3 | 100 |
| 35 | air | | | | | | 79.0 | 100 |
| 36 | | | | | 1400 | | 45.2 | 100 |
| 37 | | | | | 800 | | 78.5 | 100 |
| 38 | | | | | | | 74.2 | 100 |
| 39 | | | | | 850 | | 79.0 | 100 |
| 40 | | | | | | | 80.0 | 100 |
| 41 | | | | | 780 | | 77.5 | 100 |

= Au alloy containing submerged-reduction gold and gas atomized Ni
= Au alloy containing submerged-reduction gold and gas atomized Sn

What is claimed is:

1. A precious metal article consisting essentially of a solid-phase sintered product of a precious metal powder free of any binder, whereby assuming color tone of the precious metal.

2. A method for manufacturing a precious metal article comprising preparing a moldable mixture containing a precious metal powder and a binder which is removable by sintering, shaping said moldable mixture into a prescribed molded object, and subjecting said molded object to solid-phase sintering operation to provide the precious metal article free of said binder.

3. A method for manufacturing a precious metal article according to claim 2, further comprising preparing a base object removable by the sintering; said shaping step including extending said moldable mixture on said base object; said sintering step including sintering said molded object and said base object, whereby said base object is removed away during the sintering.

4. A method for manufacturing a precious metal article according to claim 3, wherein said base object is composed of a material combustible during said sintering.

5. A method for manufacturing a precious metal article according to claim 3, wherein said base object is formed of a material liquefiable during said sintering.

6. A method for manufacturing a precious metal article according to claim 3, wherein said base object is formed of a material vaporizable during said sintering.

7. A method for manufacturing a precious metal article according to claim 2, wherein said shaping step includes forming said moldable mixture into a plate and punching a prescribed part of said plate to provide said molded object of a prescribed shape.

8. A method for manufacturing a precious metal article according to claim 2, further comprising preparing at least two kinds of the moldable mixtures, said shaping step including forming one of said moldable mixtures into a plate and removing a prescribed portion of said plate to form a vacant region, and stuffing the other moldable mixture into said vacant region of said plate to provide said molded object.

9. A method for manufacturing a precious metal article according to claim 2, further comprising preparing at least two kinds of moldable mixtures which assume different colors by the sintering operation, blending said moldable mixtures to provide a blended moldable material, and forming said molded objects using said blended moldable material.

10. A method for manufacturing a precious metal article according to claim 9, further comprising subjecting a sintered product obtained in said sintering step to plastic working.

11. A method for manufacturing a precious metal article according to claim 2, further comprising causing a glass material to adhere to said molded object at a prescribed surface thereof, whereby when said sintering step is carried out, said glass material is melted and extended on the object.

12. A method for manufacturing a precious metal article according to claim 2, further comprising placing a jewel on said molded object whereby when said sintering operation is completed, said jewel remains on the precious metal article.

13. A method for producing a moldable mixture for use in the manufacture of a precious metal article, comprising the steps of:

preparing a precious metal powder;

preparing a jellylike cellulose binder by blending a cellulose with water and leaving for a prescribed period of time; and blending said precious metal powder and said jellylike cellulose binder together.

14. A method for producing a moldable mixture for use in the manufacture of a precious metal article according to claim 12, wherein said cellulose and water are blended at a ratio of cellulose to water of 5/95 to 30/70, and the binder formed is blended in an amount of 7 to 33% by weight with respect to the total amount of the moldable mixture.

15. A method for producing a moldable mixture for use in the manufacture of a precious metal article according to claim 14, further comprising adding ethylene glycol in an amount of no greater than 30% by weight with respect to water.

16. A method for producing a moldable mixture for use in the manufacture of a precious metal article according to claim 15, further comprising adding 0.05 to 5% by weight of a surface-active agent, whereby facilitating the mixing.

17. A method for producing a moldable mixture for use in the manufacture of a precious metal article according to claim 15, further comprising adding 0.5 to 10% by weight of an adhesion-preventing agent, whereby improving handling characteristics of the mixture.

18. A method for producing a moldable mixture for use in the manufacture of a precious metal article according to claim 15, further comprising adding 0.05 to 5% by weight of a surface-active agent and 0.5 to 10% by weight of an adhesion-preventing agent.

19. A method for producing a moldable mixture for use in the manufacture of a precious metal article according to claim 13, further comprising preparing gold powder by submerged-reduction method and an alloy powder by atomizing method, and mixing said gold powder and alloy powder thus prepared to provide said precious metal powder.

20. A method according to claim 19, further comprising including an atomizing alloy powder of a metal selected from the group consisting of nickel, palladium, zinc, cobalt, beryllium, tin and indium.

* * * * *